US009310097B2

(12) United States Patent
Harley et al.

(10) Patent No.: US 9,310,097 B2
(45) Date of Patent: Apr. 12, 2016

(54) ACCESSIBLE CABINET ELECTRIC HEATING SYSTEM AND METHOD

(71) Applicant: Twin-Star International, Inc., Delray Beach, FL (US)

(72) Inventors: Chris Harley, Boynton Beach, FL (US); Rui Hu, Dong Guan (CN); Corey Levy, Boulder, CO (US); Jianmin Huang, Dongguan (CN); Matthew Crowe, Chelsea (CA)

(73) Assignee: TWIN-STAR INTERNATIONAL, INC., Delray Beach, FL (US)

( * ) Notice: Subject to any disclaimer, the term of this patent is extended or adjusted under 35 U.S.C. 154(b) by 461 days.

(21) Appl. No.: 13/707,398

(22) Filed: Dec. 6, 2012

(65) Prior Publication Data

US 2014/0161425 A1 Jun. 12, 2014

(51) Int. Cl.

| | |
|---|---|
| ***F24D 15/02*** | (2006.01) |
| ***F24D 5/10*** | (2006.01) |
| ***F24H 3/04*** | (2006.01) |
| ***F24H 3/06*** | (2006.01) |
| ***F24H 9/20*** | (2006.01) |
| ***A47B 97/00*** | (2006.01) |

(52) U.S. Cl.

CPC ..... *F24H 3/0417* (2013.01); *A47B 97/00* (2013.01); *F24H 3/062* (2013.01); *F24H 9/2071* (2013.01); *A47B 2220/03* (2013.01)

(58) Field of Classification Search

None

See application file for complete search history.

(56) References Cited

U.S. PATENT DOCUMENTS

| | | | | |
|---|---|---|---|---|
| 1,444,621 | A * | 2/1923 | Lynn et al. | 392/374 |
| 2,919,338 | A * | 12/1959 | Covault et al. | 392/356 |
| 3,180,972 | A * | 4/1965 | Covault | 392/356 |
| 3,575,582 | A * | 4/1971 | Covault | 392/356 |
| 3,973,101 | A * | 8/1976 | Bosse | 392/369 |
| 4,035,610 | A * | 7/1977 | Roth | 392/349 |
| 4,309,594 | A * | 1/1982 | Jones | 392/356 |
| 4,882,467 | A * | 11/1989 | Dimick | 219/219 |
| 5,621,846 | A * | 4/1997 | Smith et al. | 392/376 |
| 5,884,007 | A * | 3/1999 | Fein | 392/367 |
| 6,122,437 | A * | 9/2000 | Johnson | 392/376 |
| 6,297,481 | B1 * | 10/2001 | Gordon | 219/406 |
| 7,190,887 | B1 * | 3/2007 | Compton | 392/365 |
| 8,285,127 | B2 * | 10/2012 | Mulder | 392/347 |
| 8,886,024 | B2 * | 11/2014 | Tyburk | 392/350 |
| 2008/0240689 | A1 * | 10/2008 | Coke | 392/367 |
| 2012/0281974 | A1 * | 11/2012 | Gallo et al. | 392/365 |
| 2013/0251353 | A1 * | 9/2013 | Amberson | 392/365 |
| 2014/0044423 | A1 * | 2/2014 | Chu | 392/348 |

FOREIGN PATENT DOCUMENTS

| | | | |
|---|---|---|---|
| CN | 201203261 | * | 3/2009 |

* cited by examiner

*Primary Examiner* — Thor Campbell

(74) *Attorney, Agent, or Firm* — Johnson & Martin, P.A.; James David Johnson

(57) ABSTRACT

An electric heating system is provided with a heater mountable and removable in a cabinet by a user using a mounting system. The mounting system may include at least an installation member, installation receiver, and bracket. The installation member may interface with a surface or interior shelf of the cabinet. The bracket is includable between the surface or interior shelf of the cabinet and the surface of the heater. The installation member may be receivable by the bracket. The bracket may be received by the installation receiver or an additional bracket. The electrical cable may pass through a portal locatable on the cabinet. The heater may be an infrared heater with a fan. A wired or wireless remote with an optional display may control operation of the heater. A method is provided to manipulate the electric heating system.

20 Claims, 9 Drawing Sheets

ACCESSIBLE CABINET ELECTRIC HEATING SYSTEM AND METHOD

FIELD OF THE INVENTION

The invention relates to heaters. More particularly, the invention relates to heaters installable in a cabinet.

BACKGROUND

Heating systems exist in the present market to increase the temperature of a given space. Some of these heating systems include a radiator, which may or may not be filled with a fluid, to transfer heat to a space using convection. However, such systems are incapable or vastly inefficient for moving air within the space. Many current heaters are also undesirably bulky.

Heaters are often installed in areas to conserve space and heat a room or other environment. Heaters are sometimes located in bathrooms. Heaters are often fixedly mounted in walls or vanities in the bathroom. These fixed heaters can be expensive to install and maintain. Typically, the fixed heaters require a contractor or carpenter to install the heater in a vanity and an electrician to connect the heater to the electrical system of the house or building in which the fixed heater is installed. These fixed heaters are manufactured to be installed by builders and are unsuitable for direct sales to end users.

What is needed is an electric heater that is installable in a cabinet by a user or end user. What is also needed is an electrical heater that can be easily removed by a user should the heater require service. Moreover, what is needed is a heating system with a mounting system that allows the user or end user to easily install or remove an electric heater in a cabinet or other space.

SUMMARY

According to embodiments of the present invention, an electric heating system is described that is installable into a cabinet by a user or end user. An electric heating system is also provided with an electrical heater that can be easily removed by a user should the heater require service. Moreover, an electric heating system is provided with a mounting system that allows the user or end user to easily install or remove an electric heater in a cabinet or other space.

In one aspect, an electric heating system is provided with a heater, a mounting system, and an electrical cable. The heater may be mountable in a cabinet using the mounting system. The mounting system may further include one or more installation member, one or more installation receiver, and one or more bracket. The installation member may interface with a surface of the cabinet or an interior shelf includable in the cabinet. The installation receiver may be located on a surface of the heater. The installation member may be received by the installation receivers. A bracket is includable between the surface or interior shelf of the cabinet and the surface of the heater. The installation member may be receivable by the bracket. The bracket may be received by the installation receiver or an additional bracket. The electrical cable may be attached to the heater at a first end of the cable, a plug being includable at a second end of the cable to interface with an outlet. The heater is installable in the cabinet and removable from the cabinet by a user using the mounting system.

In another aspect of the electric heating system, the system may additionally include a portal locatable on a surface of the cabinet. The electrical cable may be passed through the portal and extendable to the electrical outlet.

In another aspect of the electric heating system, the cabinet may be a vanity with a countertop or a sink, the heater being installable in the vanity.

In another aspect of the electric heating system, the heater may be proximately located near the bottom of the cabinet.

In another aspect of the electric heating system, the heater may be controllable using a remote controller. The remote controller may be wireless.

In another aspect of the electric heating system, the remote controller may include a display to provide feedback to the user from the heater.

In another aspect of the electric heating system, the heater may include an infrared heating element to heat air and a fan to move the air away from the infrared heating element.

In one aspect, an electric heating system is provided with a heater, a fan, a mounting system, and a remote controller. The heater may include an infrared heating element, a fan, and a portal located on a cabinet. The heater may be mountable in the cabinet using a mounting system. The heater may be controlled using a remote controller. The mounting system may further include an installation member, and installation receiver, and brackets. The installation member may interface with a surface of the cabinet or an interior shelf includable in the cabinet. The installation receiver may be located on a surface of the heater, the installation member being receivable by the installation receivers. A bracket may be included between the surface or interior shelf of the cabinet and the surface of the heater. The installation member may be received by the bracket. The bracket may be received by the installation receiver or an additional bracket. The portal may be located on a surface of the cabinet. The heater may be installable in the cabinet and removable from the cabinet by a user using the mounting system.

In another aspect of the electric heating system, an electrical cable may be attached to the heater at a first end of the cable. A plug may be included at a second end of the cable to interface with an outlet. The cable may be passed through the portal and extended to the electrical outlet.

In another aspect of the electric heating system, the cabinet may be a vanity with a countertop or a sink, the heater being installable in the vanity.

In another aspect of the electric heating system, the heater may be proximately located near the bottom of the cabinet.

In another aspect of the electric heating system, the remote controller may be wireless.

In another aspect of the electric heating system, the remote controller may include a display to provide feedback to the user from the heater.

A method aspect of the invention is provided for manipulating an electric heating system. The electric heating system may include a heater and a mounting system. The method aspect may include mounting the heater in a cabinet using the mounting system to facilitate installation or removal of the heater from the cabinet by a user. Mounting the heater may further include interfacing an installation member with a surface of the cabinet or an interior shelf includable in the cabinet. Mounting the heater may additionally include operatively connecting the installation member to an installation receiver located on a surface of the heater. The installation member may be receivable by the installation receivers. A bracket may be included between the surface or interior shelf of the cabinet and the surface of the heater. The installation member may be received by the bracket. The bracket may be received by the installation receiver or an additional bracket.

The method aspect may further include routing an electrical cable attached to the heater at a first end of the cable, a plug being includable at a second end of the cable to interface with an electrical outlet. The method aspect may also involve including a portal located on a surface of the cabinet, the electrical cable being passable through the portal and extendable to the electrical outlet.

According to the method aspect, the cabinet may be a vanity with a countertop or a sink, the heater being installable in the vanity.

The method aspect may further include an initial step of proximately locating the heater is near the bottom of the cabinet.

According to the method aspect, the heater may include an infrared heating element to heat air and a fan to move the air away from the infrared heating element.

According to the method aspect, the heater may be controllable using a remote controller that is wired or wireless. The remote controller may include a display to provide feedback to the user from the heater.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions, will control.

DETAILED DESCRIPTION

Figure 1:
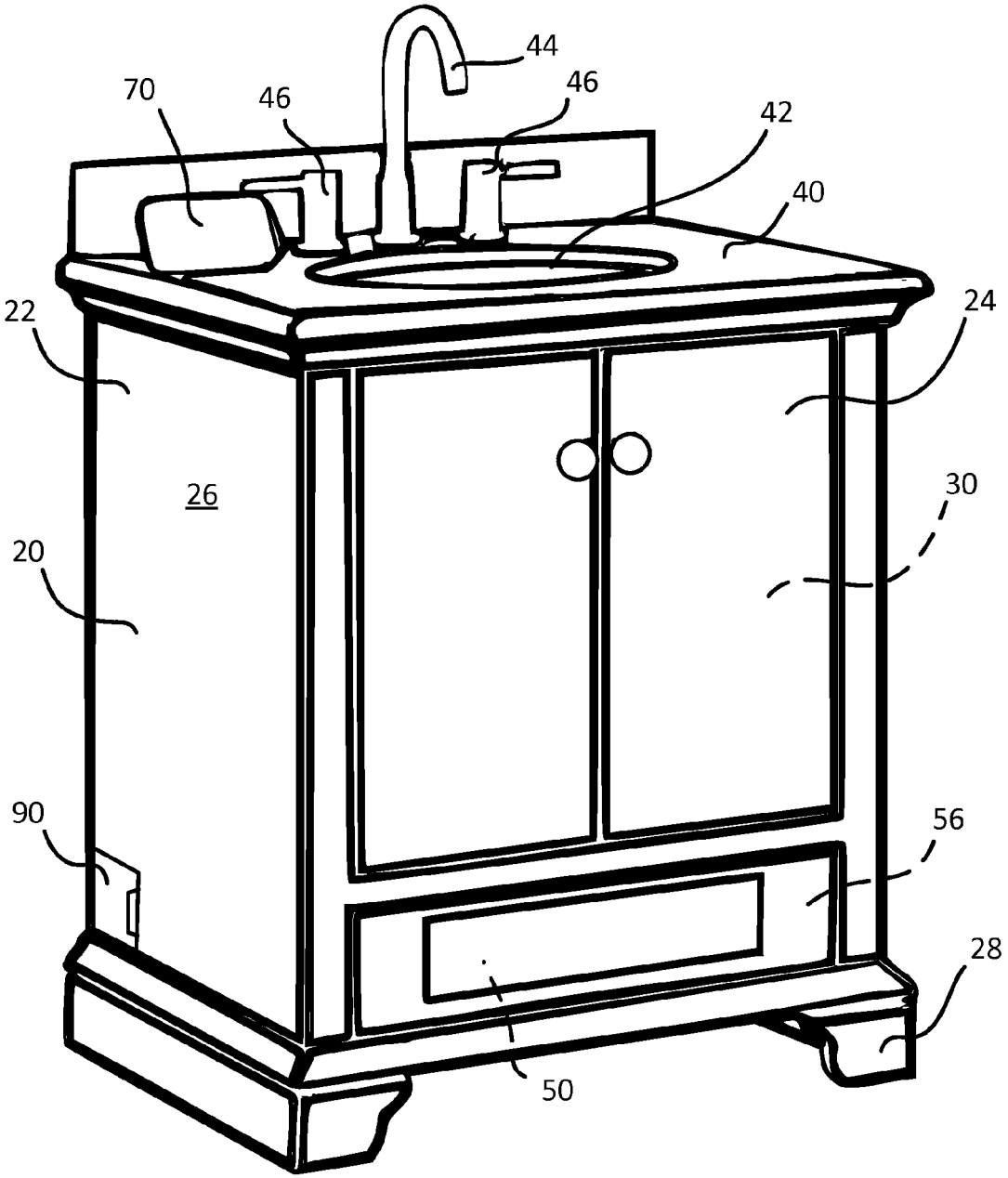
FIG. 1 is a perspective view of an electric heating system installed in a cabinet, according to an embodiment of the present invention.
Figure 3:
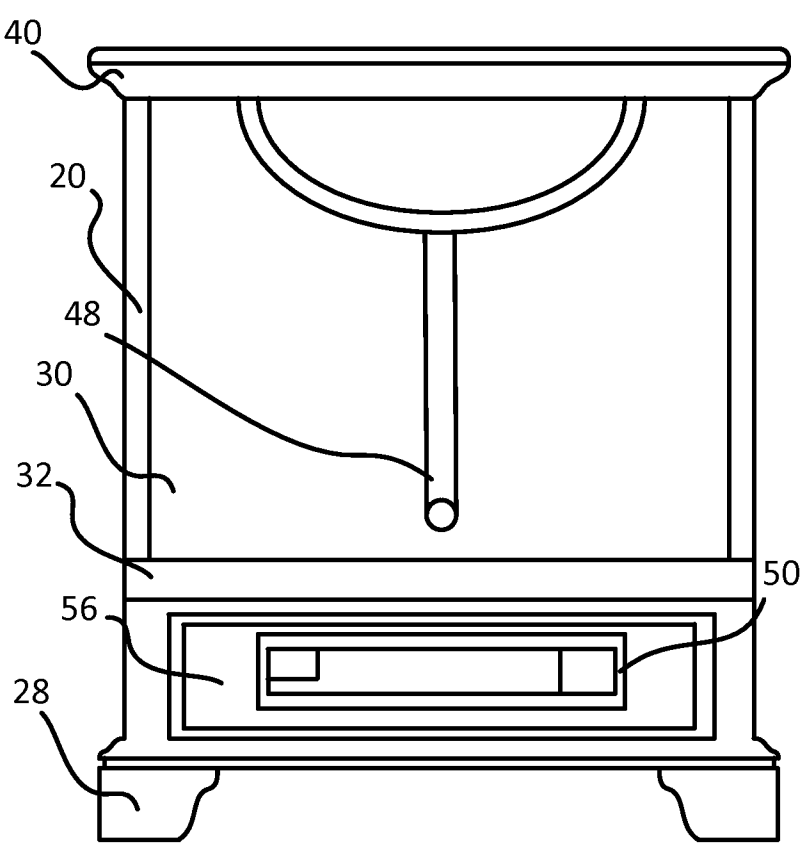
FIG. 3 is a front elevation view of an electric heating system installed in a cabinet with the interior of the cabinet exposed, according to an embodiment of the present invention.
Figure 2:
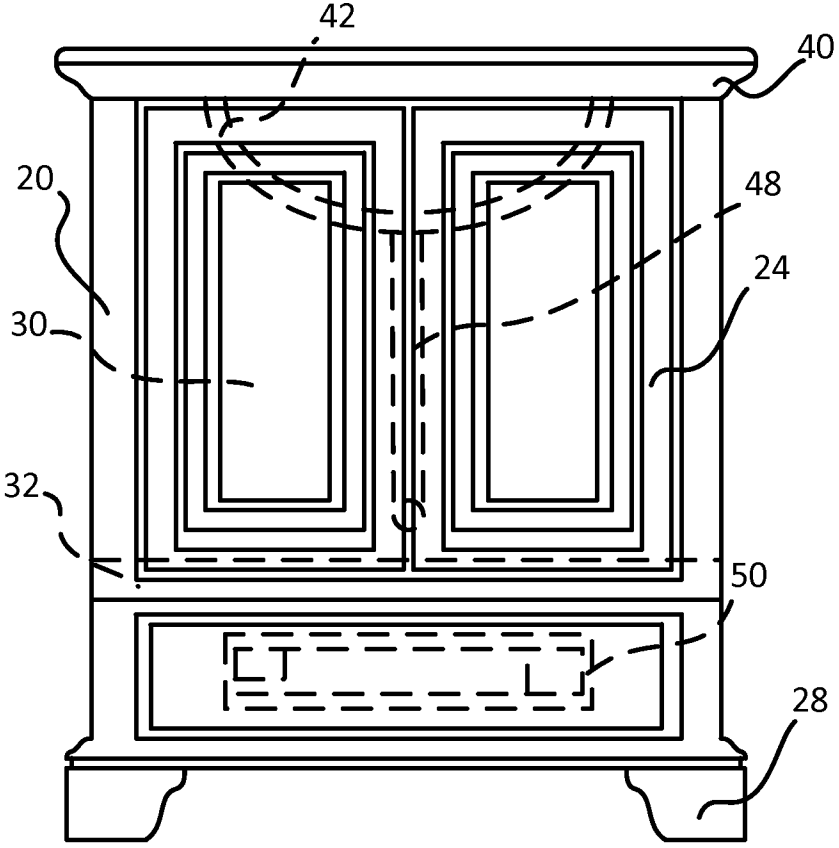
FIG. 2 is front elevation view of an electric heating system installed in a cabinet, according to an embodiment of the present invention.
Figure 4:
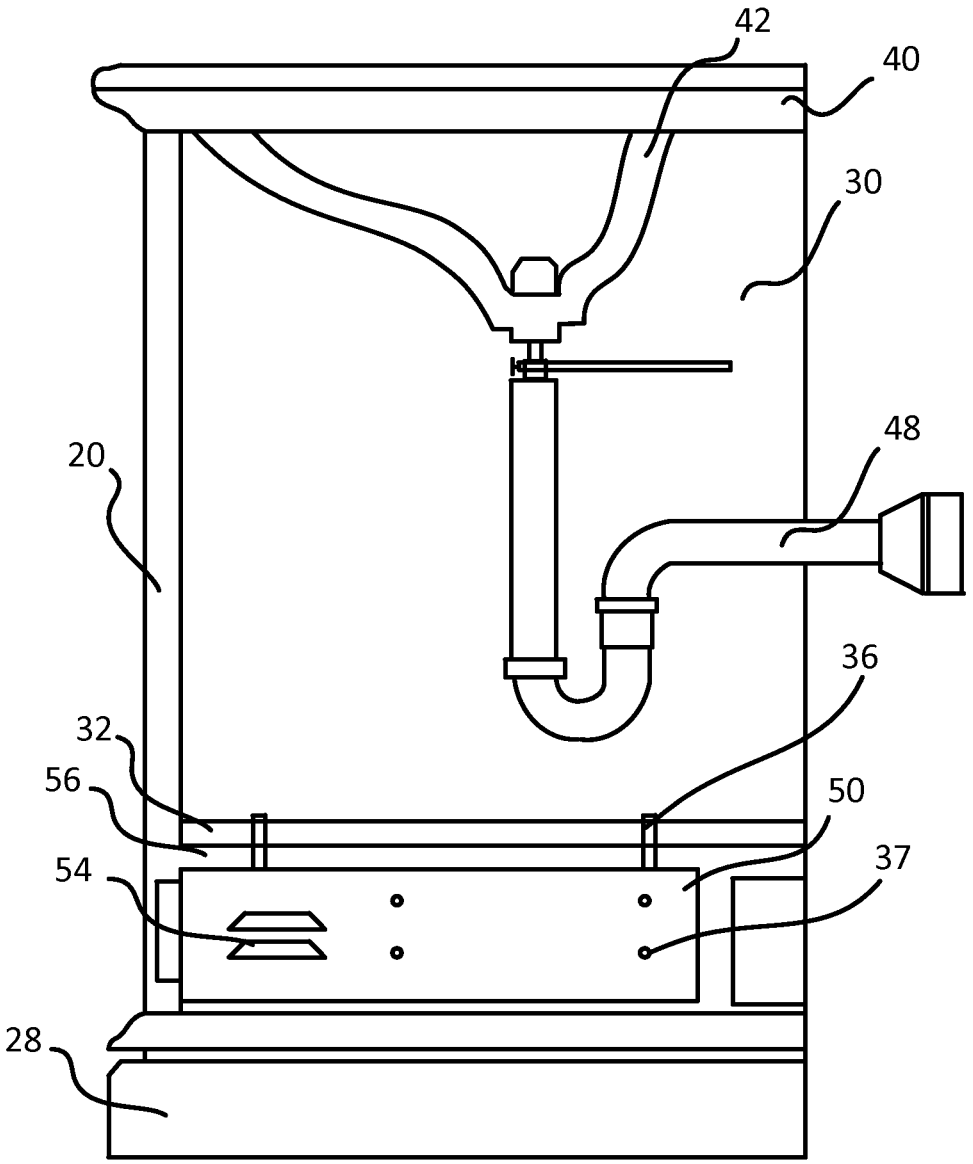
FIG. 4 is a side elevation view of an electric heating system installed in a cabinet, according to an embodiment of the present invention.
Figure 5:
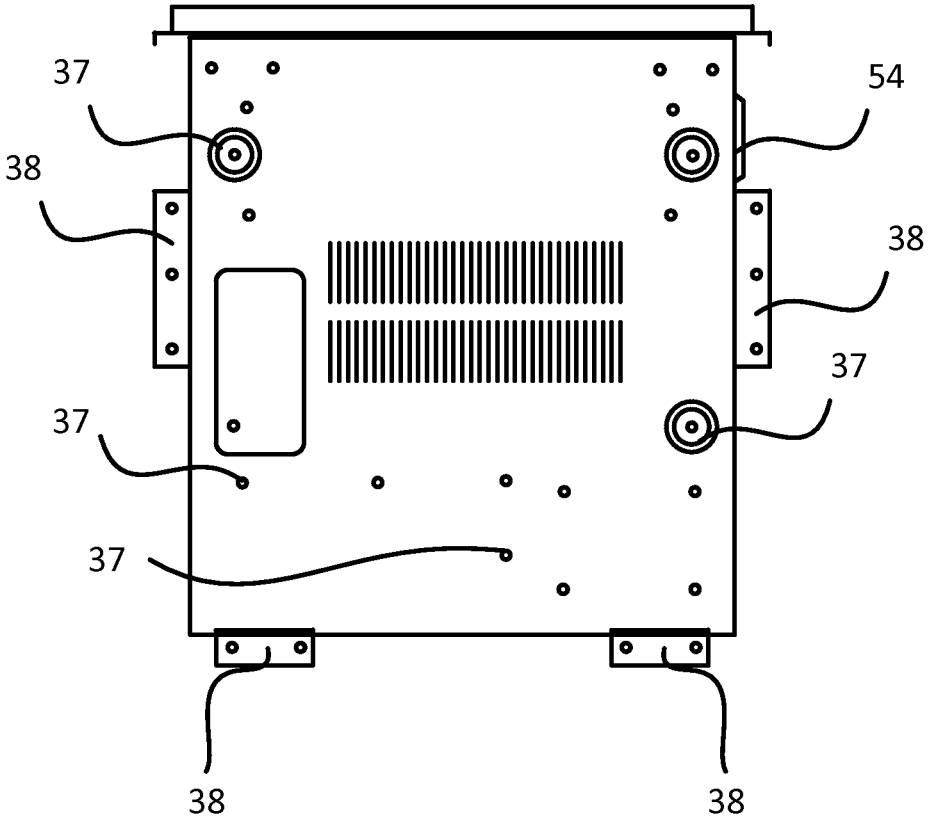
FIG. 5 is a top plan view of the electric heater, according to an embodiment of the present invention.
Figure 6:
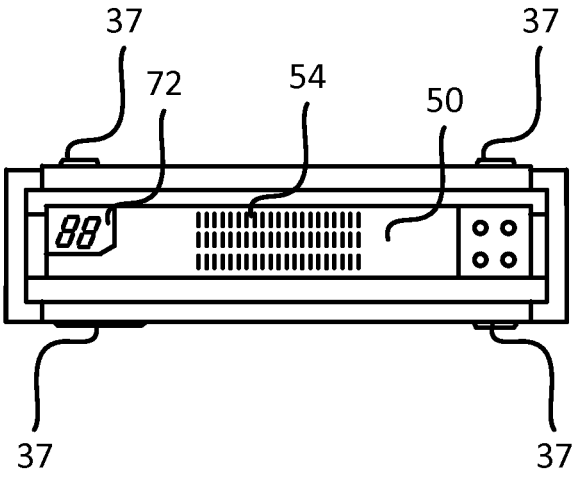
FIG. 6 is a front elevation view of the electric heater of FIG. 5.
Figure 7:
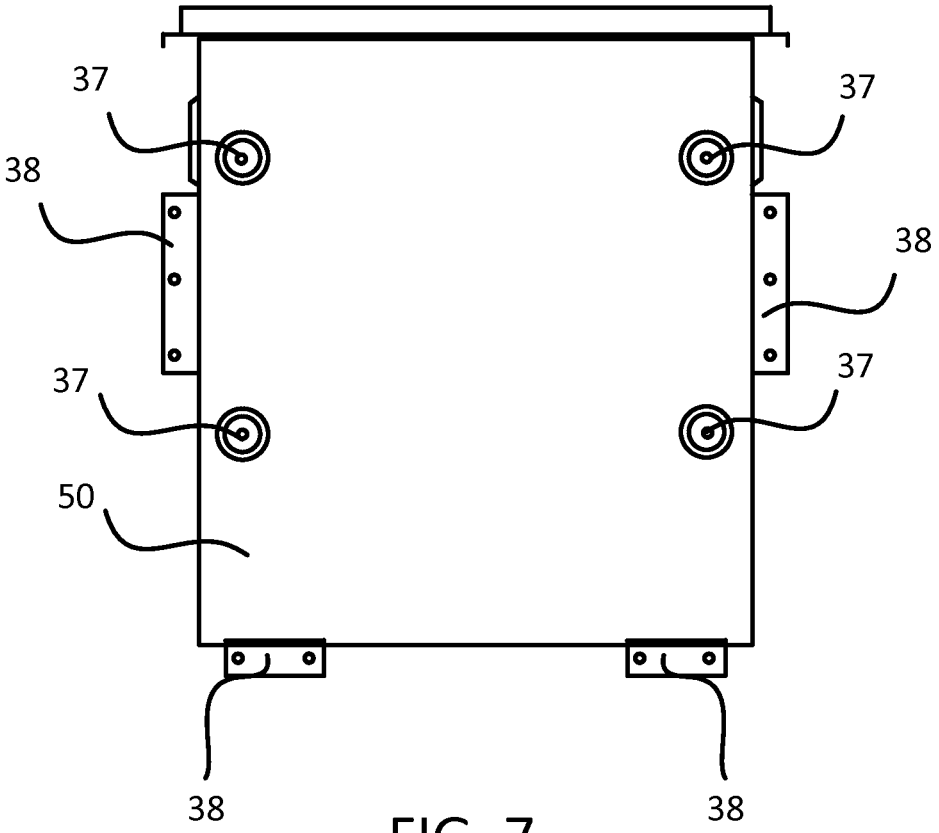
FIG. 7 is a bottom plan view of the electric heater of FIG. 5.
Figure 8:
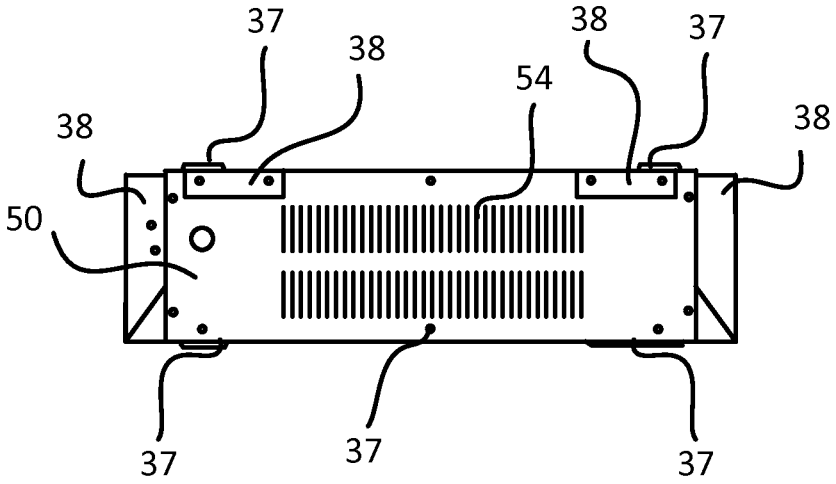
FIG. 8 is a rear elevation view of the electric heater of FIG. 5.
Figure 9:
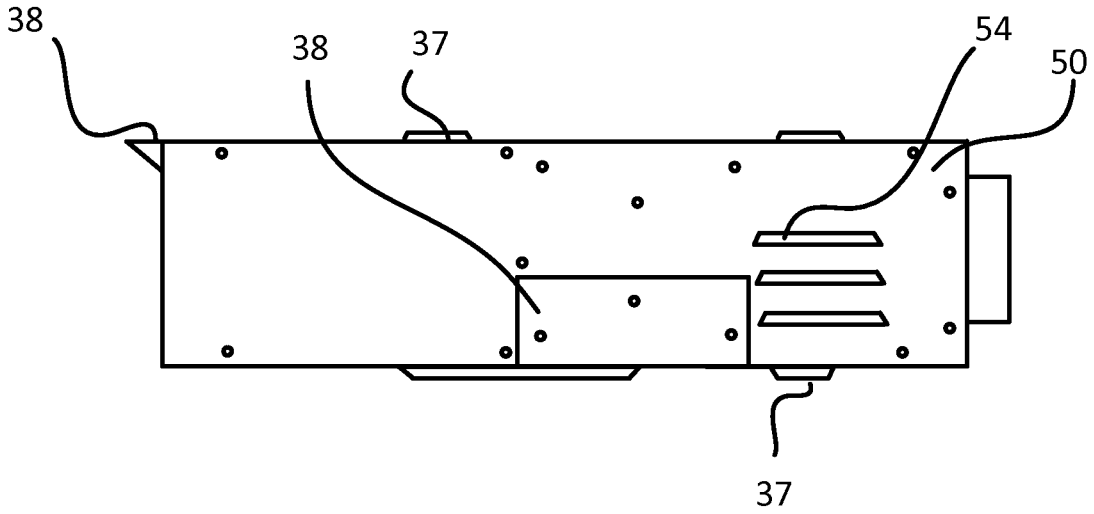
FIG. 9 is a left elevation view of the electric heater of FIG. 5.
Figure 10:
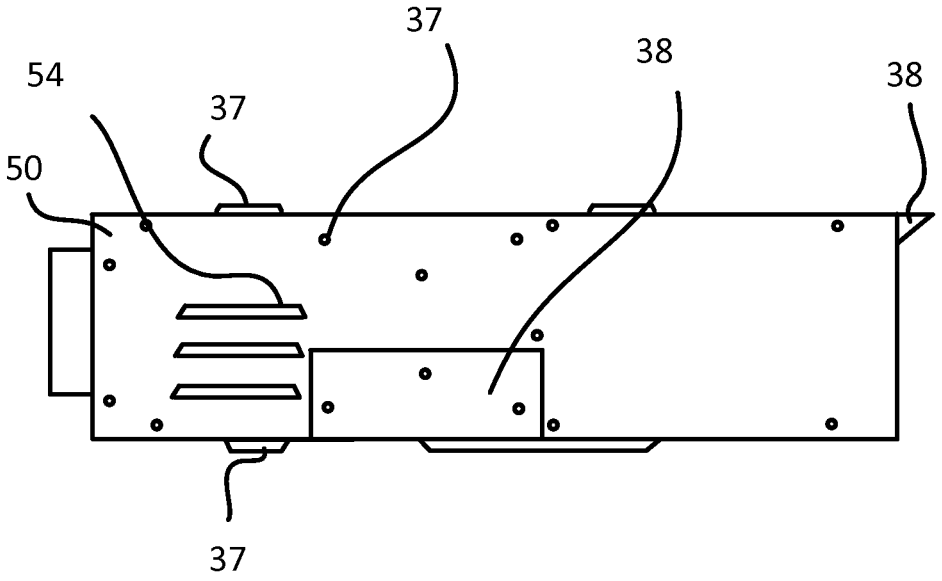
FIG. 10 is a right elevation view of the electric heater of FIG. 5.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The present invention will now be described in detail with reference to embodiments thereof as illustrated in the accompanying drawings. In the following description, an electric heating system will be discussed. Those of skill in the art will appreciate alternative labeling of the electric heating system as a heating system, system, apparatus, the invention, or other similar names. Skilled readers should not view the inclusion of any alternative labels as limiting in any way.

Referring now to FIGS. 1-4, an electric heating system, according to an embodiment of the present invention, will now be described. The electric heating system may generally include a heater 50 and a mounting system installable in a cabinet 20. The mounting system may allow the heater 50 to be installed and removed by a user or end user. The heater 50 may be installed in the cabinet 20 near the base or bottom of the cabinet 20. In some embodiments, the cabinet 20 may be a vanity (e.g., a bathroom vanity). The vanity may be installed in a bathroom or in another room of a dwelling or other building. Also, in some embodiments, the cabinet 20 may be manufactured and/or sold to a user with the heater 50 pre-installed.

The cabinet 20 will now be discussed in more detail. FIGS. 1-4 illustrate an example of a cabinet 20 in which the heating system may be installed. The cabinet 20 is illustrated as a vanity to provide an example of one type of cabinet 20 that may be used with the heating system of the present invention. Skilled artisans will appreciate that the heating system may be installed in cabinets 20 of many various configurations, and should not view the invention to be limited to installations in vanities, such as illustrated in FIGS. 1-4.

The cabinet 20 may include multiple surfaces 26, such as sides 22 and a front. The surfaces 26 may enclose an interior space 30 of the cabinet 20. The back of the cabinet 20 may optionally left open, and a wall or surface against which the cabinet 20 is installed may partially enclose the interior space 30. The cabinet 20 may include one or more doors 24, which may provide access to the interior space 30. The cabinet 20 may optionally include legs 28, which may be located between the body of the cabinet 20 and the floor surface on which the cabinet 20 is located. Skilled artisans will appreciate various additional configurations of the cabinet 20, surfaces 26, legs 28, and/or other components as contemplated by this invention after having the benefit of this disclosure.

As previously discussed, the cabinet 20 may be a vanity, which may include a countertop 40 with a sink 42. The sink 42 may extend from the countertop 40 into the interior space 30 of the cabinet 20. Plumbing 48 may connect to the sink 42 with the plumbing system of the house or building in which the vanity may be installed to drain wastewater. A faucet 44 and water valves 46 may also be included with the vanity to deliver fresh water to a user. The faucet 44 and valves 46 may also be connected to the plumbing 48 of the house or room to provide the fresh water. The plumbing 48 connected to the sink 42, faucet 44, and valves 46 may be at least partially included in the interior space 30 of the cabinet 20.

The cabinet 20 may also include a heater space 56 to receive and accommodate a heater 50. The heater space 56 may be located near the bottom of the cabinet 20. However, skilled artisans will appreciate additional locations at which the heater space 56 may be located. The heater space 56 may be located within the interior of the cabinet 20. An interior shelf 32 may be installed in the cabinet 20 to separate the heater space 56 from the remaining interior space 30 of the cabinet 20. In an embodiment where the heater space 56 is located proximately near the bottom of the cabinet 20, the interior shelf 32 may be installed above the heater space 56 and below the remaining interior space 30. The doors 24 may be configured to provide access to the remaining interior space 30 of the cabinet 20, so that the heater 50 and heater space 56 may be substantially permanently exposed to the room independent of whether the doors 24 are opened or closed.

The interior shelf 32 may be operatively connected to the sides 22 and other surfaces 26 of the cabinet 20. Shelf bolts 34 may be used to directly or indirectly connect the interior shelf 32 to the cabinet 20. For example, the shelf bolts 34 may be installed to pass through at least part of the interior shelf 32 and be received by a side 22 or other surface 26 of the cabinet 20. Alternatively, one or more adapters or brackets 38 may be included on the sides 22 or other surfaces 26 of the cabinet 20 on which the interior shelf 32 may be placed. Shelf bolts 34 may then be passed through at least part of the interior shelf 32 to be received by the brackets 38, which may be operatively connected to the cabinet 20. The shelf bolts 34 may be secured to the cabinet 20 or brackets 38 through threaded holes. Alternatively, the shelf bolts 34 may be secured to the cabinet 20 or brackets 38 by passing through an opened area of the cabinet 20 and/or bracket 38 to a receiving device, such as a threaded nut. In some configurations, the heater 50 may be operatively connected to the interior shelf 32 via the mounting system, which will be discussed in greater detail below. In an embodiment of the present invention, the interior shelf 32 may rest on brackets 38 and/or other components of the cabinet 20 without being attached, the position of the interior shelf 32 being maintained at least partially by its weight.

Referring now additionally to FIGS. 5-10, the heater 50 will now be discussed in greater detail. The heater 50 may be virtually any heating device that produces heat from electrical energy. The electric heater 50 may produce heat using electrical resistance, infrared radiation, or other heating techniques. The electric heater 50 may draw the electrical energy used to create heat from a household electrical grid to which it is connected. The heater 50 may also include one or more thermostat to detect the temperature of heated air produced by the heater 50 and/or an ambient temperature of a room or space being heated.

An electrical heater 50 using resistive heating elements may operate by passing an electrical current through a conductor to release heat. The conductor may be coiled or configured in other shapes and/or orientations Skilled artisans will appreciate the principals of resistive heating, which are otherwise known in the art as ohmic heating or Joule heating.

An electrical heater 50 using infrared radiation may also be included in the heater 50, which may be desirable due to the properties of the heat radiated from the infrared heater 50. An infrared heater 50 may include an infrared heating element, which may transfer energy from a high temperature body to a low temperature body through electromagnetic radiation. As materials within the infrared heating element are excited, they may emit infrared radiation of varying bands. As an example, far infrared emitters may include a range of at least 3000 nanometers and above.

Examples of infrared heating elements will now be discussed. Those of skill in the art will appreciate that the following examples are provided only as examples, and should not be viewed to limit the present invention in any way. The infrared heating element may be constructed using a glass tube, which may be highly purified. The glass tube may be formed using quartz, due to properties of quart that radiate infrared heat at high temperatures without melting. A wire or element may be included in the glass tube. More specifically, provided in the interest of clarity and without limitation, a tungsten wire, nichrome (NiCr) wire, halogen element, carbon fiber element may be included in the glass tube.

The electrical heater 50 may include vents 54 to allow air to enter and exit the interior of the heater 50. For example, air may be drawn into the heater 50 through a set of vents 54. The air may then be heated by the heating elements of the heater 50. The heated air may be expelled from the heater 50 in a desired direction through an additional set of vents 54. The vents 54 may include fins, which may direct the air being expelled by the heater 50 in one or more directions. The fins of the vents 54 may be configured to expel heated air in various directions to substantially evenly heat a room or space.

The electrical heater 50 may include a fan to direct the heated air away from the heating elements. The fan may be, without limitation, an axial, centrifugal, coanda, convective, crossflow, electrostatic, or other fan type. In the interest of clarity, an embodiment that includes a crossflow fan will be discussed in greater detail. A crossflow fan includes an impeller of blades positioned about an axis. The blades of the impeller are typically long, such that the impeller may be rotated about a vertical axis. The blades may have a forward curved shape. The impeller may be located within the electric heater 50, and may be oriented to determine a flow direction of the air moved by the fan. As the impeller may rotate in the electric heater 50, heated air may move transversely across the impeller and out of the heater 50.

The electric heater 50 may be connected to a power supply, such as the electrical grid of a household. An electrical cable may be connected to the heater 50 through which power may be drawn. More specifically, without limitation, the electrical cable may have a first and second end. The first end of the electrical cable may be connected to the heater 50. This connection may be made during the manufacturing of the heater 50.

The second end of the electrical cable may include a plug. Inclusion of a plug at the second end of the electrical cable advantageously reduces the likelihood that an electrician will be required to install the heating system of the present invention. The plug may be configured to be received by an electrical outlet. For example, and without limitation, an electrical plug installed on the second end of the electrical cable for markets in the US may include a prong configuration to fit a typical American 110 volt electrical outlet. Additional configurations may be provided for European or other regional outlets, which may draw 220 volts or other voltage levels from the electrical outlet. The plugs that attach to the second end of the electrical cable may be selected respective to the intended geographic market of the heating system. Optionally, the plugs may be interchangeable.

The heater 50 may include one more installation receivers 34. The installation receivers 34 may receive an installation member 32. Installation receivers 34 may be included on one or more surface of the heater 50. An example of an installation receiver 34 may be, for example, a threaded hole. Correspondingly, an example of an installation member 32, without limitation, may include a threaded bolt. Skilled artisans will appreciate additional configurations by which an installation member 32 may be received and secured by an installation receiver 34 after having the benefit of this disclosure. Connections between the installation members 32 and installation receivers 34 will be discussed in greater detail along with the mounting system below.

Referring now to FIGS. 2-12, the mounting system will now be discussed in greater detail. The mounting system may be included with the heating system to allow a user to install and remove the heater 50 from the cabinet 20. The mounting system advantageously provides a physical connection between the heater 50 and the cabinet 20 that is user accessible.

Figure 11:
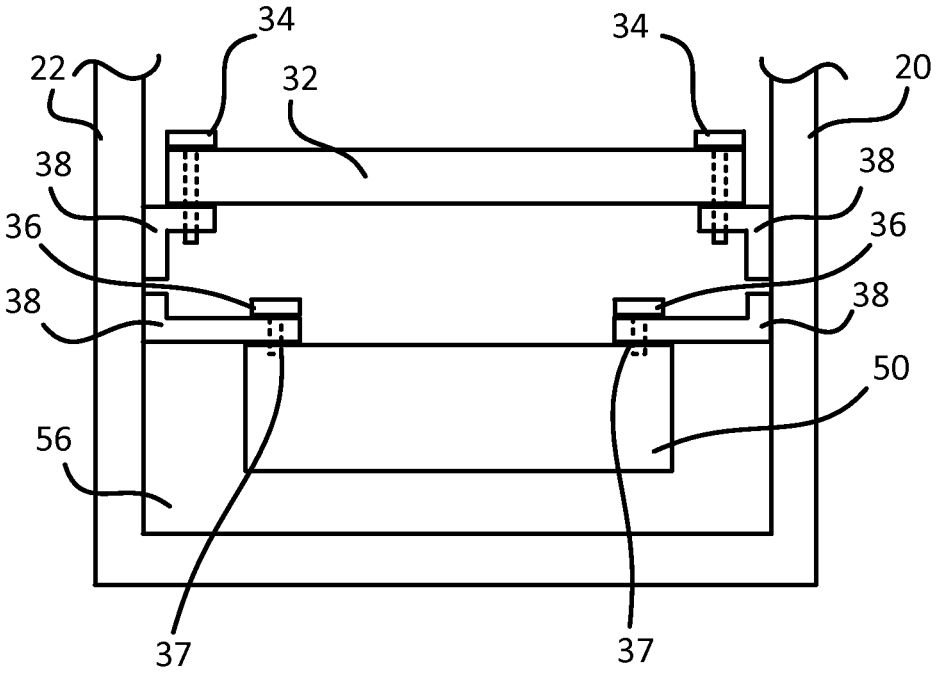
FIG. 11 is a front elevation view of a mounting system, according to an embodiment of the present invention.

As a feature of the mounting system, the interior shelf 32 may be removable to provide access to the heater space 56. The interior shelf 32 may be connected to the cabinet 20 via shelf bolts 34, which can be inserted, secured, loosened, or removed by a user. Loosening and removing the shelf bolts 34 may allow the interior shelf 32 to be removed, granting access to the heater space 56, as illustrated in FIG. 11. Removing the interior shelf 32 may also provide access to the installation members 32, which may also be inserted, secured, loosened, or removed by a user. The user may then loosen or remove the installation members 32, to gain access to the heater 50.

Figure 12:
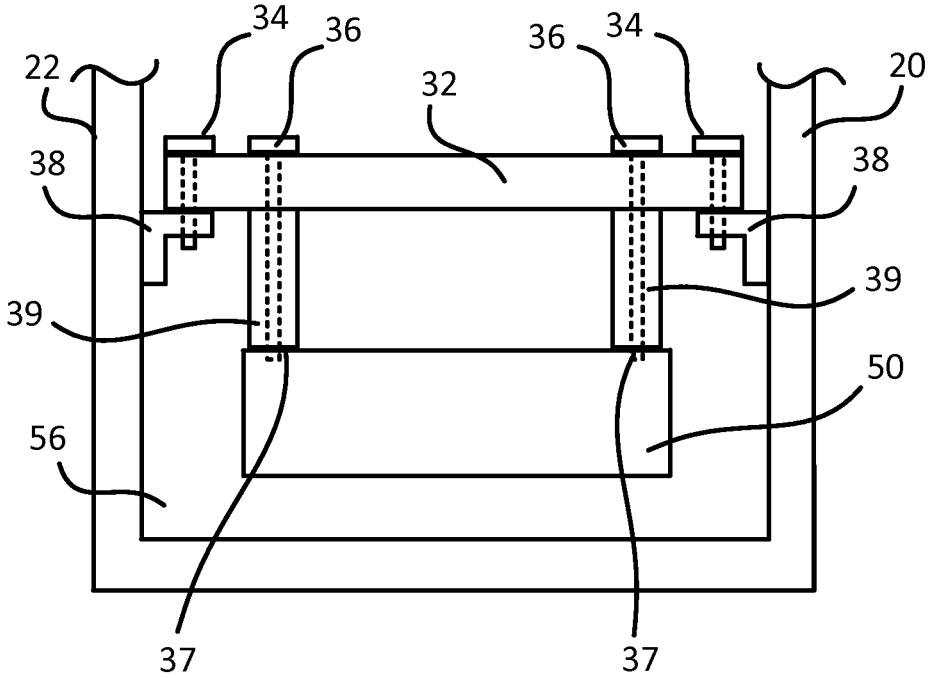
FIG. 12 is a front elevation view of an alternative mounting system, according to an embodiment of the present invention.

Alternatively, as illustrated in FIG. 12, the installation members 32 may be passed through at least part of the interior shelf 32 and connected to the heater 50. By removing the interior shelf 32, the user may also remove the heater 50 from the heater space 56. One or more spacer 39 may be included between the interior shelf 32 and the heater 50. The aforementioned configurations of the heater 50 in relation to the interior shelf 32 are provided as examples, and are not intended to limit the mounting system or present invention in any way.

In other embodiments of the mounting system, additional components may be included to connect the heater 50 to the cabinet 20. Examples of additional components includable in the mounting system may contain rails, guides, locking mechanisms, compressive devices, levers, braces, springs, rivets, and tethers. Additionally, components may be included in the mounting system to adapt the angle at which the heater 50, cabinet 20, and/or interior shelf 32 are connected. For example, a bracket 38 may be included with the mounting system to allow an installation member 32 to connect to other components via the bracket 38, which connects to a surface 26 of the cabinet 20. The bracket 38 may alter the connection angle by which an installation member 32 is received by an installation receiver 34, providing flexibility of mounting angles and configurations. The heater 50 may then be connected to the bracket 38, effectively securing the heater 50 to the cabinet 20 via the bracket 38. Brackets 38 may be included and/or attached to the cabinet 20, heater 50, interior shelf 32, additional bracket 38, and/or other components included in or interfacing with the heating system.

Figure 13:
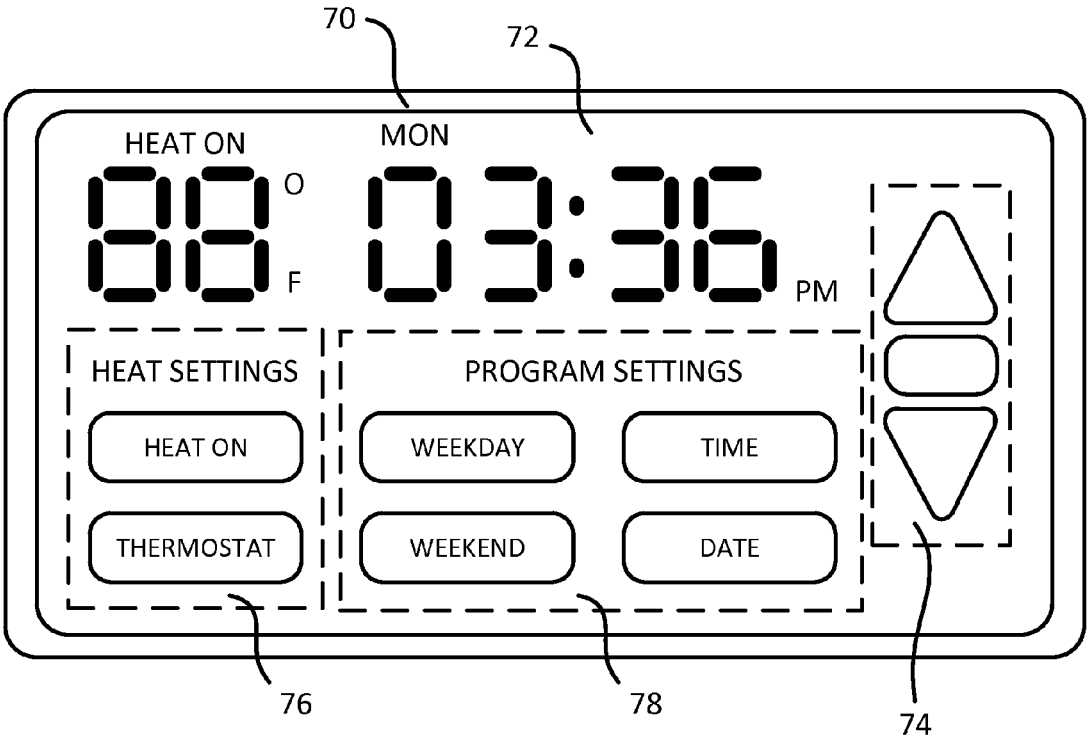
FIG. 13 is a front elevation view of a remote controller with a display, according to an embodiment of the present invention.
Figure 15:
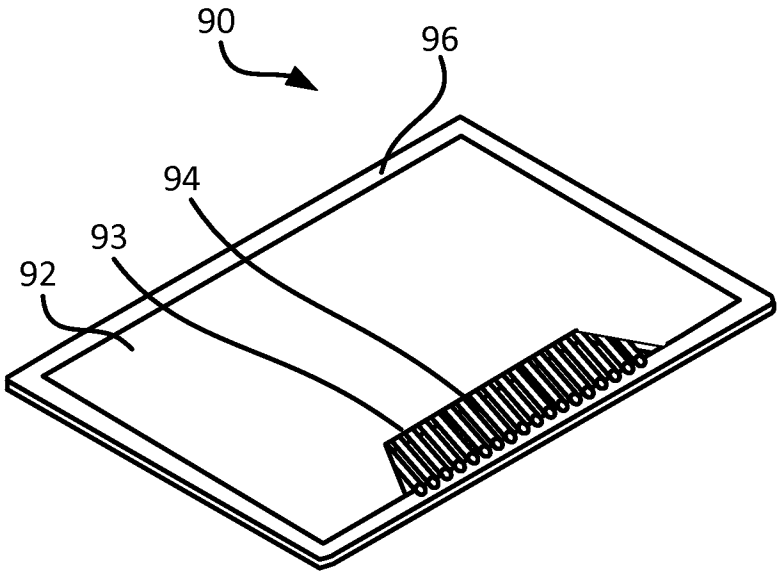
FIG. 15 is a perspective view of the portal of FIG. 14 being closed.
Figure 14:
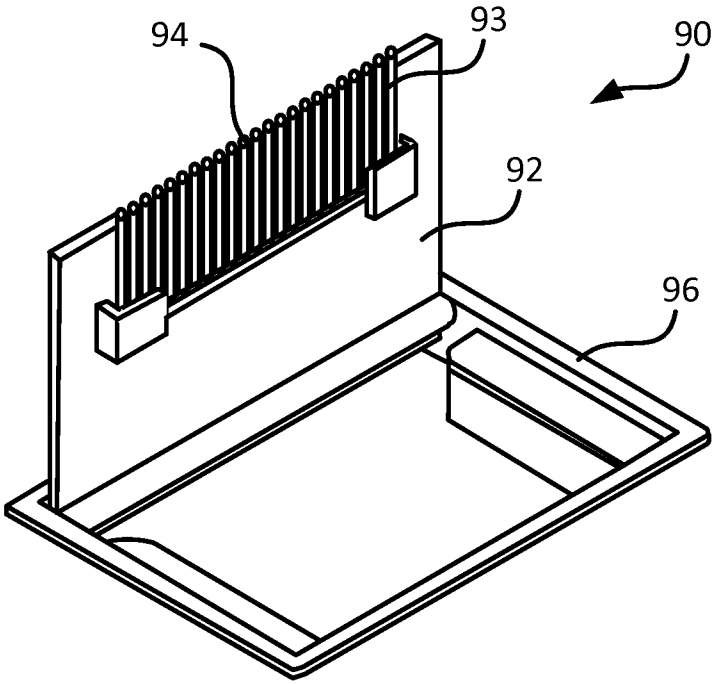
FIG. 14 is a perspective view of a portal installable on the cabinet, the portal being opened, according to an embodiment of the present invention.

A remote controller 70 may be included with the heating system to control operation of the heater 50. Additionally, the remote controller 70 may include a display 72 to provide operational feedback to a user. An example of a remote controller 70 is provided in FIGS. 1 and 13 without limitation. The remote controller 70 may be connected to the heater 50 via a wired and/or wireless connection. For example, the remote controller 70 may operate wirelessly to control the heater 50. The remote controller 70 may also include an option to connect to the heater 50 via a wired connection to control the heater 50, charge the remote controller 70, and/or otherwise operate the heating system.

The remote controller 70 may include one or more buttons that the user may interact with to control a feature of the heating system. For example, the remote controller 70 may include temperature control buttons 74. The temperature control buttons 74 may be used to increase or decrease a desired temperature of a space. The heater 50 may then engage operation to heat the space when the approximate ambient temperature drops below the desired temperature selected by using the remote controller 70. The ambient temperature may be detected by a thermostat included in the heater 50. Alternatively, the temperature control buttons 74 may be used to control the level and/or intensity of heat being produced by the heater 50.

The remote controller 70 may additionally include buttons 76 to manipulate heat settings, which may include a master power button for the heating system, display options, or other operational settings for the heating system. For example, a "HEAT ON' button may be used to switch the heater 50 between an operational and nonoperational state. Also, as an example, a "THERMOMETER" button may be used to display 72 the current temperature of the room or space on a display 72 that may be included on the remote controller 70.

The remote controller 70 may include buttons 78 to program the operation of the heating system. For example, the program settings buttons 78 may be used to define a time for the heating system to engage and disengage operation. The program settings buttons 78 may be used in operation with the temperature control buttons 78 to define the program parameters. For example, a user may desire to set a program for the heating system. The user may select the "WEEKDAY" button to program a start and stop time for the weekday. The user may then manipulate the temperature control buttons 74 to set a range of weekdays to apply the program. Using the "DATE" and/or "TIME" buttons, the user may also define a start and/or stop time for the heating system. Through use of the program settings buttons 78, the user may advantageously define a heater program to heat a room or space to a desired temperature prior to or upon entering. For example, a user may program the heating system to heat a bathroom to a comfortable 78 degrees in the morning, so when the user wakes up to get ready for work, he or she will not have to enter a cold or unpleasant bathroom.

As mentioned above, the remote controller 70 may optionally include a display 72. Alternatively, a display 72 may be included elsewhere by the heating system, for example, on the heater 50. Skilled artisans will appreciate that the heating system may include multiple displays 72, which may be located on or adjacent to the remote controller 70, heater 50, cabinet 20, and/or other location. The display 72 may include a plurality of indicators, providing feedback for the operation of the heating system. In the example illustrated by FIG. 13, the display 72 may include indicators regarding temperature, measurement units such as Fahrenheit/Celsius, operational status of the heater 50, date, time, and other information. The information provided by the display 72 may be changed by interacting with the buttons of the remote controller 70. For example, engaging the program settings buttons 78 may change the information provided by the display 72 from the current date and time to the start and/or stop times of the heating program. Skilled artisans will appreciate additional information that may be provided via the display 72.

Optionally, a portal 90 may be included on a surface 26 of the cabinet 20, as illustrated in FIGS. 1, 4, and 14-15. An object may be passed through the portal 90 such that one end is located in the interior space 30 of the cabinet 20 and another end is located outside of the cabinet 20. For example, the portal 90 may be located at the lower portion of a side 22 of the cabinet 20 to provide access to the heater space 56. An electrical cable may be passed from the heater space 56 and/or interior space 30 through the portal 90 to a space outside of the cabinet 20. The electrical cable may then be extended or routed to an electrical outlet, advantageously eliminating the need to hard-wire the heating system to an electrical system of a house or building, which may advantageously eliminate the need to hire an electrician.

The portal 90 may include a portal door 92, which may be manipulated between an open and closed configuration. The portal door 92 may be movably attached to a portal perimeter 96, which may be installed into a hole or removed portion of the cabinet 20. The portal door 92 may include an indentation 92 of sufficient size to accommodate an object, such as a cable. Optionally, a dust shield 94 may be included near the indentation 93 to decrease the likelihood of dust or debris entering the heater space 56. The portal door 92 may be opened to accommodate passing the plug of the electrical cable through its opening. Once the plug has been passed through the portal 90, the portal door 92 may be closed on the electrical cable, with the length of the electrical cable passing through the indentation 93 of the closed portal door 92.

In an embodiment of the present invention, the heating system may include a safety mechanism to reduce the likelihood of device malfunction. Safety mechanisms may include, but should not be limited to, fuses, circuit breakers, overvoltage protection devices, over-temperature detectors, and other safety mechanisms that would be apparent to a person of skill in the art after having the benefit of this disclosure.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A cabinet-installed electric heating system comprising:

a cabinet comprising a removable interior shelf and an interior space inside the cabinet;

a heater mountable in the cabinet using a mounting system, the mounting system further comprising:

an installation member interfacing with the removable interior shelf of the cabinet, and an installation receiver located on a surface of the heater to receive the installation member or a bracket includable between the removable interior shelf of the cabinet and the surface of the heater, the installation member being receivable by the bracket, and the bracket being receivable by the installation receiver or an additional bracket; and an electrical cable attached to the heater at a first end of the cable and comprising a plug at a second end of the cable to interface with an outlet;

wherein the heater is removably installable on the removable interior shelf of the cabinet and wherein the interior shelf and heater installed thereon are removably installable within the interior space of the cabinet.

2. The system of claim 1, further comprising a portal locatable on a surface of the cabinet, the electrical cable being passable through the portal and extendable to the electrical outlet.

3. The system of claim 1, wherein the cabinet comprises a vanity with a countertop and a sink.

4. The system of claim 1, wherein the heater is proximately located near a bottom of the cabinet.

5. The system of claim 1, wherein the heater is controllable using a remote controller.

6. The system of claim 5, wherein the remote controller is wireless.

7. The system of claim 1, wherein the heater is installed on a bottom surface of the removable interior shelf.

8. The system of claim 1, wherein the heater comprises an infrared heating element to heat air and a fan to move the air away from the infrared heating element.

9. A cabinet-installed electric heating system comprising:

a cabinet comprising a removable interior shelf and an interior space inside the cabinet;

a heater comprising an infrared heating element to heat air and a fan to move air, wherein the heater is mountable in the cabinet using a mounting system, the heater being controllable using a remote controller, the mounting system further comprising:

an installation member interfacing with the removable interior shelf includable in the cabinet, and an installation receiver located on a surface of the heater to receive the installation member or a bracket includable between the removable interior shelf of the cabinet and the surface of the heater, the installation member being receivable by the bracket, and the bracket being receivable by the installation receiver or an additional bracket; and a portal located on a surface of the cabinet;

wherein the heater is installable on the removable interior shelf of the cabinet and wherein the interior shelf and heater installed thereon are removably installable within the interior space of the cabinet.

10. The system of claim 9, further comprising an electrical cable attached to the heater at a first end of the cable and comprising a plug at a second end of the cable to interface with an outlet, the cable being passable through the portal and extendable to the electrical outlet.

11. The system of claim 9, wherein the cabinet comprises a vanity with a countertop and a sink.

12. The system of claim 9, wherein the heater is proximately located near the bottom of the cabinet.

13. The system of claim 9, wherein the remote controller is wireless.

14. The system of claim 9, wherein the heater is installed on a bottom surface of the removable interior shelf.

15. A method of manipulating an electric heating system, the electric heating system comprising a heater and a mounting system, wherein the cabinet comprises a removable interior shelf and an interior space inside the cabinet, the method comprising the steps of:

(a) mounting the heater on the removable interior shelf of the cabinet using the mounting system to facilitate installation or removal of the heater from the interior space inside the cabinet by a user, further comprising the steps of:

(1) interfacing an installation member with the removable interior shelf includable in the cabinet, and (2) operatively connecting the installation member to an installation receiver located on a surface of the heater, the installation member being receivable by the installation receivers or a bracket includable between the removable interior shelf of the cabinet and the surface of the heater, the bracket being receivable by the installation receiver or an additional bracket;

(b) routing an electrical cable, the cable comprising a first end attached to the heater and a second end comprising a plug to interface with an electrical outlet (c) including a portal located on a surface of the cabinet, the electrical cable being passable through the portal and extendable to the electrical outlet.

16. The method of claim 15, wherein the cabinet is a vanity with a countertop and a sink.

17. The method of claim 15, further comprising before step (a) proximately locating the heater near the bottom of the cabinet.

18. The method of claim 15, wherein the heater comprises an infrared heating element to heat air and a fan to move the air away from the infrared heating element.

19. The method of claim 15, wherein the heater is controllable using a remote controller that is wired or wireless.

20. The method of claim 15, wherein the heater is installed on a bottom surface of the removable interior shelf.

* * * * *